United States Patent [19]

Berwick et al.

[11] 4,424,268

[45] Jan. 3, 1984

[54] PYRYLIUM- AND THIOPYRYLIUM-SENSITIZED LOW-PERSISTENCE PHOTOCONDUCTIVE COMPOSITIONS AND ELEMENTS

[75] Inventors: Martin A. Berwick, Kendall; Lawrence E. Contois, Webster; George A. Reynolds, Rochester, all of N.Y.

[73] Assignee: Eastman Kodak Company, Rochester, N.Y.

[21] Appl. No.: 443,787

[22] Filed: Nov. 22, 1982

[51] Int. Cl.[3] ..... G03G 5/09

[52] U.S. Cl. ..... 430/83

[58] Field of Search ..... 430/83, 95

[56] References Cited

U.S. PATENT DOCUMENTS

| | | | |
|---|---|---|---|
| 3,554,745 | 1/1971 | Van Allan | 430/83 X |
| 3,577,235 | 5/1971 | Contois | 430/83 |
| 3,586,500 | 6/1971 | Contois et al. | 430/83 X |
| 3,997,345 | 12/1976 | Sakurai et al. . | |
| 4,045,220 | 8/1977 | Contois et al. . | |
| 4,152,152 | 5/1979 | Contois et al. | 430/83 |

*Primary Examiner*—Roland E. Martin, Jr.

*Attorney, Agent, or Firm*—Torger N. Dahl

[57] ABSTRACT

Protonic acid-free photoconductive compositions and elements comprising a photoconductor and, as a sensitizer, a 4-tertiaryaminobenzo[b]pyrylium salt or a 4-tertiaryaminobenzo[b]thiopyrylium salt. The resulting compositions and elements exhibit low persistent conductivity.

17 Claims, No Drawings

PYRYLIUM- AND THIOPYRYLIUM-SENSITIZED LOW-PERSISTENCE PHOTOCONDUCTIVE COMPOSITIONS AND ELEMENTS

FIELD OF THE INVENTION

The present invention relates to photoconductive compositions and elements containing pyrylium or thiopyrylium salts as sensitizers.

In the now well-known process of xerography, the surface of a photoconductive composition on an element is uniformly charged and imagewise-exposed to form a latent charge image. The latent image is rendered visible by development with an electroscopic marking material which is attracted selectively to charged or uncharged portions of the image. A description of this process is provided in U.S. Pat. No. 3,577,235 issued May 4, 1971, to L. E. Contois.

The properties of the photoconductive composition employed will depend on the type of copy process in which it is employed. For some applications, compositions exhibiting so-called "persistent conductivity" are desirable as such property permits repeated charge-develop-image transfer sequences following a single imagewise exposure of an initially charged photoconductive element so long as the conductivity of the element persists. Thus, one can generate many copies from a single exposure.

For other applications, however, persistence is unwanted, and it is to this end that the present invention is directed. For example, when it is desired to employ the photoconductive element in a new imaging cycle, the insulative photoconductor should return to its electrically insulative state immediately after exposure in order to permit a new imaging cycle. If the photoconductor exhibits persistence, however, copies in the next imaging cycle will exhibit ghost images of the previous cycle which are either misregistered with the image desired or simply unwanted.

Persistence is also a problem in certain single-use applications. If the time between exposure and development for each single-use photoconductor is different, the sensitometry of each photoconductor will also differ, resulting in nonuniform image density and quality among such elements.

It is the practice in the art of electrophotography to associate or incorporate sensitizing materials such as spectral sensitizing dye salts with photoconductive compositions to enhance the sensitivity of the composition in preselected spectral regions. Among many types, 4-aminobenzo[b]pyrylium and 4-aminobenzo[b]thiopyrylium salts are particularly effective spectral sensitizers for photoconductive compositions. Such sensitizers are described in U.S. Pat. No. 3,577,235 issued May 4, 1971, to L. E. Contois, U.S. Pat. No. 3,997,345 issued Dec. 14, 1976, to D. S. Bailey, and U.S. Pat. No. 4,045,220 issued Aug. 30, 1977, to L. E. Contois et al. While those sensitizers are particularly useful as such, the present inventors have found that photoconductive compositions containing 4-aminobenzo[b]pyrylium or 4-aminobenzo[b]thiopyrylium compounds exhibit persistence.

In accordance with the present invention, the persistence of photoconductive compositions comprising 4-aminobenzo[b]pyrylium or 4-aminobenzo[b]thiopyrylium sensitizing salts is substantially reduced when the amine groups on the sensitizers are tertiary and the composition is free from protonic acid. Thus, the present invention contemplates the use of tertiaryamino-pyrylium (TAP) or tertiaryaminothiopyrylium (TAT) sensitizers having the structure:

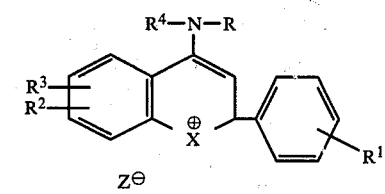

I wherein:

X is a sulfur atom or an oxygen atom;

Z is an anion such as perchlorate, fluoroborate, sulfonate, periodate or p-toluenesulfonate;

each of R and $R^4$, which are the same or different, is an alkyl group having, for example, 1 to 10 carbon atoms, such as methyl, ethyl, isopropyl, n-butyl, pentyl, octyl and decyl, including cycloalkyl such as cyclopentyl or cyclohexyl, as well as substituted alkyl groups such as aralkyl groups having, for example, 1 to 4 carbon atoms in the alkyl moiety such as benzyl, phenylethyl, phenylpropyl or phenylbutyl; an aryl group such as phenyl or naphthyl; and when taken together represent the necessary atoms to form a heterocyclic ring having from 4 to 6 carbon atoms;

$R^1$ is a hydrogen atom, a lower alkyl group having 1 to 4 carbon atoms such as methyl, ethyl, isopropyl, butyl or a lower alkoxy group having 1 to 4 carbon atoms in the alkyl moiety such as methoxy, ethoxy, propoxy or butoxy; and each of $R^2$ and $R^3$ when taken separately represents a hydrogen atom and when taken together are attached to adjacent carbon atoms and represent the atoms necessary to form a fused aromatic ring such as a benzo ring and including substituted fused aromatic rings.

The defined TAP or TAT sensitizers are employed with a photoconductor to form low-persistence, protonic acid-free compositions and elements composed of a conducting support and a layer of such composition.

As noted above, the present inventors have unexpectedly found that, when the compound represented by Structure I contains no hydrogen atoms directly appended to the amino nitrogen, i.e., the amino group is tertiary, the compound sensitizes a photoconductive composition but does not increase the persistence of the composition as do prior-art sensitizers of a similar structure having hydrogen appended to the amino nitrogen.

Suitable TAT or TAP sensitizers include the following representative compounds:

TABLE I

Sensitizer A

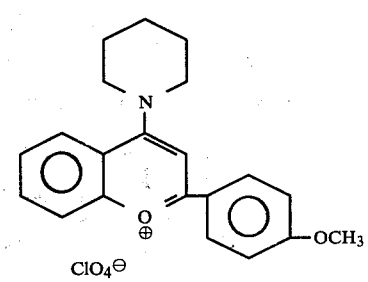

TABLE I-continued

Sensitizer B

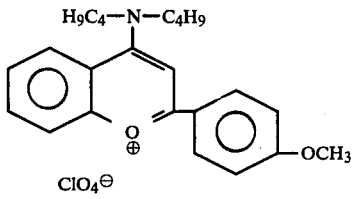

Sensitizer C

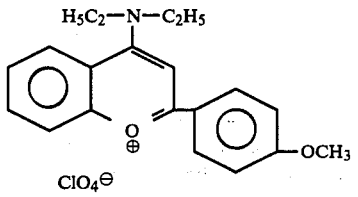

Sensitizer D

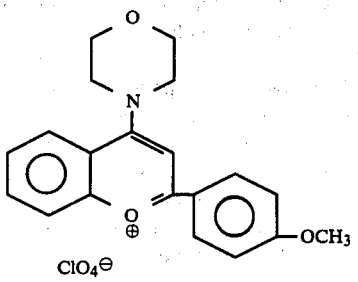

Sensitizer E

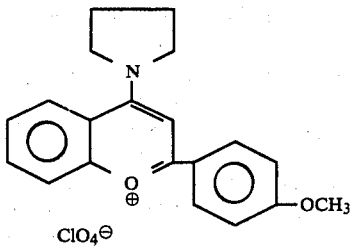

Sensitizer F

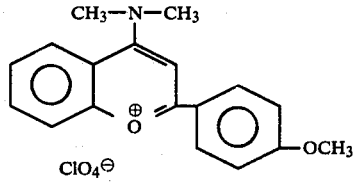

Sensitizer G

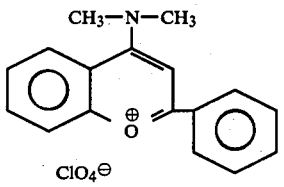

Sensitizer H

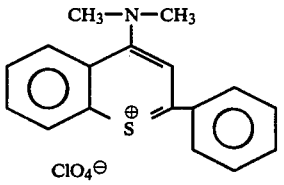

TABLE I-continued

Sensitizer I

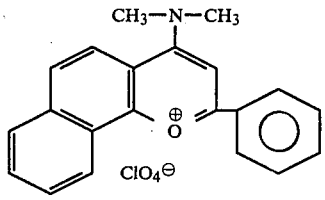

Sensitizer J

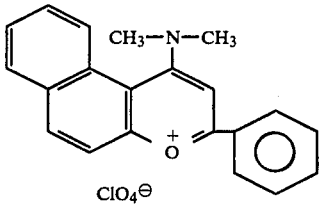

The sensitized photoconductive composition, and elements containing a layer of the composition, exhibit conductivity of low persistence. By this we mean that, immediately after charging and exposing the composition to actinic radiation, the electrical conductivity of the composition in the dark is the same or only slighter greater for a brief period of time, e.g., less than a second, than the conductivity of the composition prior to charging and exposing. In comparison with the conductivity of otherwise identical compositions containing Formula I-type sensitizers with a free hydrogen attached to the amino nitrogen, the compositions of the present invention exhibit substantially less persistent conductivity.

One or more photoconductors are useful in combination with the described TAT and TAP sensitizers. Representative photoconductors include nitrogen-free polyarylhydrocarbon photoconductors as described in U.S. Pat. No. 4,045,220 issued Aug. 30, 1977, to L. E. Contois et al, and arylmethane leuco bases as described in U.S. Pat. No. 3,542,547 issued Nov. 24, 1970, to L. E. Contois, U.S. Pat. No. 3,615,402 issued Oct. 26, 1971, to N. G. Rule, and U.S. Pat. No. 3,820,989 issued June 28, 1974, to N. G. Rule et al. The photoconductive composition containing the present TAT or TAP sensitizers can also comprise a so-called aggregate photoconductive composition containing a co-crystalline complex of an alkylidene diarylene polymer and a pyrylium dye salt (which may or may not be a TAT or TAP sensitizer as described above). Representative aggregate compositions are described in U.S. Pat. No. 3,997,342 issued Dec. 14, 1976, to D. S. Bailey.

Preferred photoconductors employed in the present invention include those of the arylmethane class described above, particularly bis(N,N-dialkylaminophenyl)phenylalkanes including crystallization-inhibiting mixtures of different arylalkane photoconductors described in U.S. Pat. No. 4,301,226 issued Nov. 17, 1981, to L. E. Contois et al.

The photoconductive compositions of the present invention preferably also comprise a polymeric binder. Useful binders include film-forming materials having fairly high dielectric strength and good electrically insulating properties. Representative binders include one or more of the following: natural resins, vinyl resins, condensation polymers including polyesters and polyamides, natural and synthetic waxes such as described in U.S. Pat. No. 4,045,220 above and in *Xerogra-*

*phy and Related Process* by Dessauer and Clark (Focal Press, Ltd., 1965, at page 165). Preferred binder polymers include one or more polyesters.

The photoconductive insulating compositions of this invention are prepared conveniently by preparing a solution or dispersion of the photoconductor, TAT or TAP sensitizer and binder. Useful results are obtained where the amount of photoconductor is at least about 1 weight percent of the composition (i.e., solids content). The upper limit of the amount of photoconductor can be widely varied in accordance with usual practice. If a binder is employed, the photoconductor can be from about 1 to about 99 weight percent of the composition. A preferred weight range for the photoconductor is from about 10 to about 60 weight percent.

A suitable amount of the sensitizing compound is mixed with the photoconductive insulating composition so that after thorough mixing the sensitizing compound is uniformly distributed throughout the composition. The amount of sensitizer which can be added to give effective increases in speed can vary widely. The optimum concentration in any given case will vary with the specific photoconductor and sensitizing compound. Substantial speed gains can be obtained where an appropriate sensitizer is added in a concentration range from about 0.0001 to about 30 percent by weight based on the weight of the photoconductive insulating composition. For purposes of the present invention, it is advantageous to keep the sensitizer concentration as low as possible, but high enough to maintain appropriate sensitometry. If the composition is designed for microfilm reader/printer-type exposures, the preferred range for the dye sensitizer concentration is from about 0.03 to about 1.0 weight percent, although lower or greater amounts can produce satisfactory results.

Surfactants such as silicon surfactants can be employed in the composition to aid in dispersal of the TAP or TAT sensitizer, as well as the photoconductor in the solution containing the binder.

The compositions of this invention can be used without associated materials, as when coated to form a self-supporting layer. This can be accomplished by coating the composition into a layer on a nonadherent surface and stripping off the coated layer, when dry, to obtain a self-supporting photoconductive insulating member. Photoconductive insulating compositions of the type described herein are also coated on an electrically conducting support material to prepare electrophotographic elements. Barrier layers, for example, cellulose nitrate barrier layers, can be interposed between the conductive support and the photoconductive layer. Optional protective overcoats such as those composed of thermoplastic resins can be applied as a layer over the photoconductive layer. Useful electrically conducting supports, as well as coating composition parameters, are described in U.S. Pat. No. 4,045,220 mentioned above.

Photoconductive compositions and elements of the present invention are employed in any of the well-known electrophotographic processes involving, for example, dark charging, exposure, and development of the resulting charge image. Representative processes are disclosed in the patent literature, such as in U.S. Pat. No. 4,045,220 above and in the Dessauer and Clark treatise also mentioned above.

The following examples are provided to aid further in the understanding of the present invention.

EXAMPLE 1

Photoconductive elements containing a cuprous iodide-coated conductive film support and an 8-micrometer layer of a homogeneous photoconductive composition thereon were prepared. The respective elements contained a TAT or TAP sensitizer from Table I in a concentration of 0.8 part by weight of the layer. The remainder of the composition contained 20 parts by weight of 4,4'-diethylamino-2,2'-dimethyltriphenylmethane and 80 parts by weight of the polyester poly[ethylene-co-isopropylidene-2,2'-bis(ethyleneoxyphenylene)-terephthalate] as binder. An otherwise identical control element containing the sensitizer:

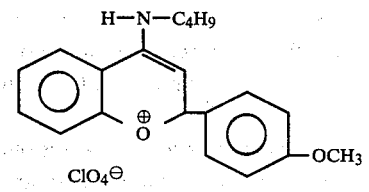

was also prepared.

Each element was exposed to radiation corresponding to a peak absorption region of the sensitizing dye employed. The persistence of each element was determined and rated as follows: Uncharged samples of the film were exposed for 2 sec through a continuous wedge step tablet using a mercury light source. They were processed with a liquid developer biased to +325 volts. A plot of density as a function of exposure showed increased density with increased exposure for persistent films. Little or no sensitivity to exposure was observed with the nonpersistent film. The results of this evaluation are shown in Table II.

TABLE II

| Sensitizer | Exposure, ergs/cm$^2$ | Persistence |
|---|---|---|
| control | 74 (390 nm) | yes |
| Sensitizer A | 245 (390 nm) | no |
| Sensitizer B | 93 (390 nm) | no |
| Sensitizer C | 86 (370 nm); 104 (390 nm) | no |
| Sensitizer D | 257 (370 nm) | no |
| Sensitizer E | 88 (390 nm) | no |
| Sensitizer F | 50 (500 nm) | no |
| Sensitizer G | 50 (630 nm) | no |
| Sensitizer H | 159 (390 nm) | no |

Although the invention has been described in considerable detail with particular reference to certain preferred embodiments therof, variations and modifications can be effected within the spirit and scope of the invention.

What is claimed is:

1. A protonic acid-free, low-persistence photoconductive composition comprising a organic photoconductor, and, as a sensitizer, a 4-tertiaryaminobenzo[b]pyrylium salt or a 4-tertiaryaminobenzo[b]thiopyrylium salt.

2. A composition as in claim 1 wherein said sensitizer has the structure:

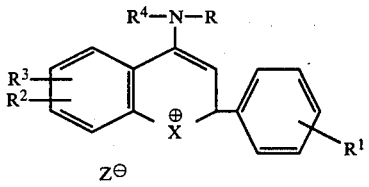

wherein:

X is sulfur or oxygen;

Z is an anion;

each of R and $R^4$, which are the same or different, is an alkyl group having 1 to 10 carbon atoms or a substituted alkyl group having 1 to 4 carbon atoms in the alkyl moiety or an aryl group; and when taken together represent the necessary atoms to form a heterocyclic ring having from 4 to 6 carbon atoms;

$R^1$ is a hydrogen atom, a lower alkyl group having 1 to 4 carbon atoms or a lower alkoxy group having 1 to 4 carbon atoms in the alkyl moiety; and each of $R^2$ and $R^3$ when taken separately represents a hydrogen atom and when taken together are attached to adjacent carbon atoms and represent the atoms necessary to form a fused aromatic ring or a substituted fused aromatic ring.

3. A composition as in claim 2 further comprising a polymeric binder.

4. A composition as in claim 2 wherein said sensitizer is from the group consisting of:

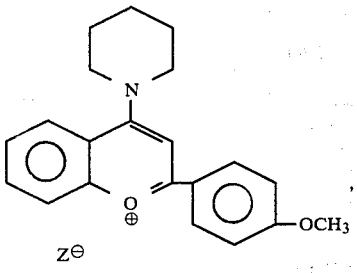

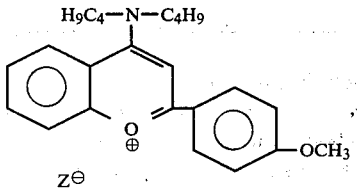

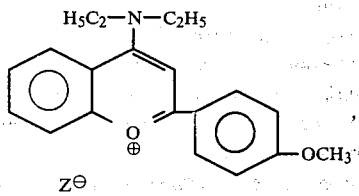

-continued

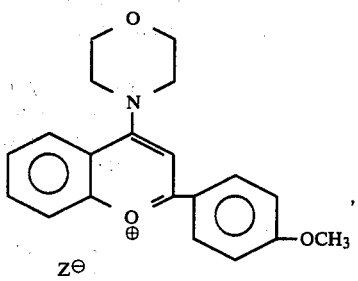

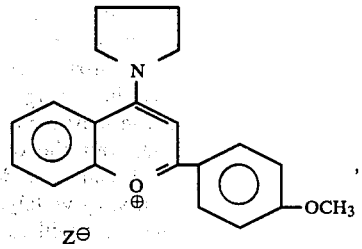

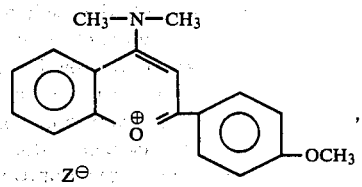

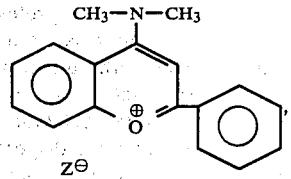

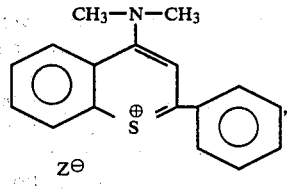

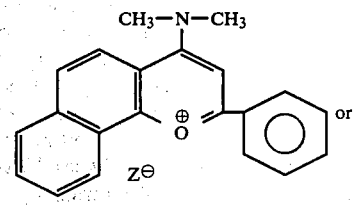

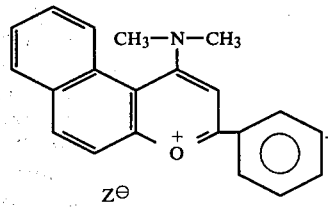

5. A composition as in claim 4 wherein the anion of said sensitizer is $ClO_4^-$.

6. A composition as in claim 3 wherein said photoconductor is an arylalkane.

7. A composition as in claim 6 wherein said arylalkane is a bis(N,N-dialkylaminophenyl)phenylalkane.

8. A composition as in claims 3, 6 or 7 wherein said polymeric binder is a polyester.

9. A low-persistence, electrophotographic element comprising an electrically conducting support and a protonic acid-free photoconductive composition of claim 1.

10. An element as in claim 9 wherein said sensitizer has the structure:

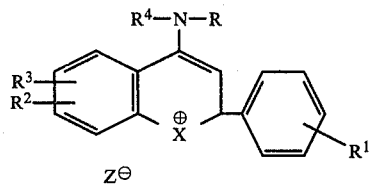

I wherein:

X is sulfur or oxygen;

Z is an anion;

each of R and $R^4$, which are the same or different, is an alkyl group having 1 to 10 carbon atoms or a substituted alkyl group having 1 to 4 carbon atoms in the alkyl moiety or an aryl group; and when taken together represent the necessary atoms to form a heterocyclic ring having from 4 to 6 carbon atoms;

$R^1$ is a hydrogen atom, a lower alkyl group having 1 to 4 carbon atoms or a lower alkoxy group having 1 to 4 carbon atoms in the alkyl moiety; and each of $R^2$ and $R^3$ when taken separately represents a hydrogen atom and when taken together are attached to adjacent carbon atoms and represent the atoms necessary to form a fused aromatic ring or a substituted fused aromatic ring.

11. An element as in claim 10 wherein said composition further comprises a polymeric binder.

12. An element as in claim 10 wherein said sensitizer is from the group consisting of:

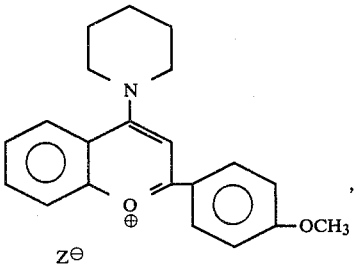

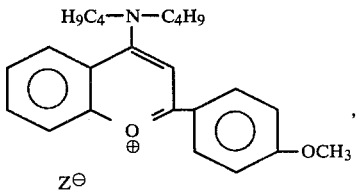

-continued

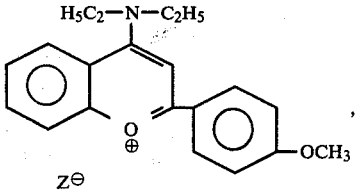

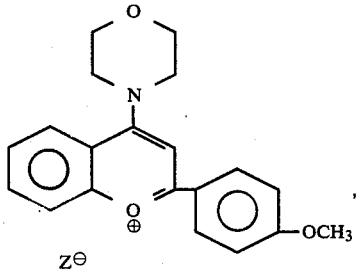

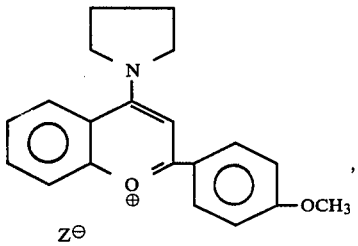

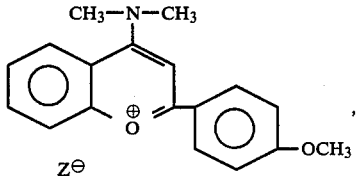

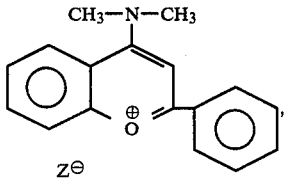

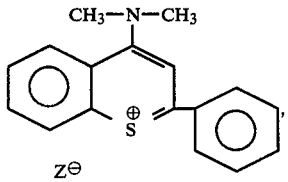

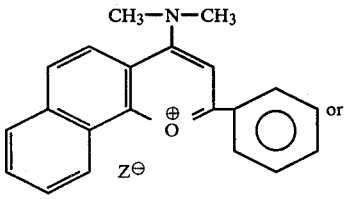

or

-continued

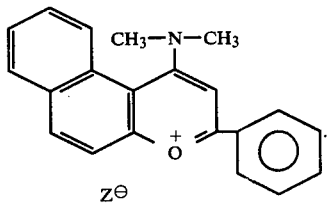

13. A composition as in claim 12 wherein the anion of said sensitizer is $ClO_4^-$.

14. An element as in claim 11 wherein said photoconductor is an arylalkane.

15. An element as in claim 14 wherein said arylalkane is a bis(N,N-dialkylaminophenyl)phenylalkane.

16. An element as in claims 11, 14 or 15 wherein said polymeric binder is a polyester.

17. An element as in claim 16 wherein said electrically conducting support comprises a film substrate and an electrically conducting layer on said substrate.

* * * * *